US007484834B2

(12) United States Patent
Inokuma

(10) Patent No.: US 7,484,834 B2
(45) Date of Patent: Feb. 3, 2009

(54) THERMAL HEAD, METHOD OF MANUFACTURING THE SAME, AND THERMAL PRINTER

(75) Inventor: Yoshihiro Inokuma, Kagoshima (JP)

(73) Assignee: Kyocera Corporation, Kyoto (JP)

( * ) Notice: Subject to any disclaimer, the term of this patent is extended or adjusted under 35 U.S.C. 154(b) by 399 days.

(21) Appl. No.: 11/260,888

(22) Filed: Oct. 27, 2005

(65) Prior Publication Data

US 2006/0098052 A1 May 11, 2006

(30) Foreign Application Priority Data

Oct. 27, 2004 (JP) ..... P2004-312152
Nov. 29, 2004 (JP) ..... P2004-344831

(51) Int. Cl.
*B41J 2/05* (2006.01)

(52) U.S. Cl. ..... 347/64

(58) Field of Classification Search ..... 347/63–65, 347/203

See application file for complete search history.

(56) References Cited

U.S. PATENT DOCUMENTS 5,745,147 A * 4/1998 Johnson et al. ..... 347/200
5,847,744 A * 12/1998 Hoki et al. ..... 347/203
6,115,055 A 9/2000 Kashiwaya et al.
6,236,423 B1 5/2001 Yamaji

FOREIGN PATENT DOCUMENTS

| | | |
|---|---|---|
| JP | 61-154954 | 7/1986 |
| JP | 02-266959 | 10/1990 |
| JP | 11-277782 | 10/1999 |
| JP | 2000-177158 | 6/2000 |
| JP | 2001-047652 | 2/2001 |
| JP | 2001-270141 | 10/2001 |

* cited by examiner

*Primary Examiner*—An H Do
(74) *Attorney, Agent, or Firm*—Hogan & Hartson LLP

(57) ABSTRACT

A thermal head in which battery effect-induced corrosion can be retarded while maintaining excellent anti-static capability in an upper conductive protective film, is provided. The thermal head includes a substrate, a heater element arranged on the surface of the substrate, an electrode layer connected to the heater element, and an upper conductive protective film for covering part of the electrode layer. In the thermal head, between the electrode layer and the upper conductive protective film is interposed a lower conductive protective film which is higher in specific resistance than the upper conductive protective film.

18 Claims, 9 Drawing Sheets

THERMAL HEAD, METHOD OF MANUFACTURING THE SAME, AND THERMAL PRINTER

BACKGROUND OF THE INVENTION

1. Field of the Invention

The present invention relates to a thermal head that is incorporated into a printer mechanism, a thermal head manufacturing method, and a thermal printer.

2. Description of the Related Art

As thermal heads of related art designed for incorporation into a printer mechanism, those as set forth hereunder have been known.

For example, disclosed in Japanese Unexamined Patent Publication JP-A 61-154954 is a thin-film type thermal head constructed by laminating, on a substrate, a heater element, a wiring conductor layer, and an abrasion-resistant protective film successively in this order. In this thermal head, the abrasion-resistant protective film is designed to have a double-layer structure including a first protective film made of an SiN-based material which exhibits high insulation resistance, and a second protective film made of an SiC-based material or TiC-based material which exhibits low insulation resistance. The second protective film, which is formed on the first protective film, is connected to a common electrode of the wiring conductor layer.

Disclosed in Japanese Unexamined Patent Publication JP-A 02-266959 is a thermal head composed of: a substrate; a heater element and an electrode formed on the substrate; an insulating layer made of $SiO_2$ for covering the heater element and the electrode; an electrically conductive layer made e.g. of NiCr, Au, or Al that is formed on the insulating layer; and a protective film made of an SiN-based, SiC-based, or TaO-based material that is formed on the electrically conductive layer. In this thermal head, the electrically conductive layer is kept at the same potential as a recording power supply voltage, and the protective film is connected to ground.

Disclosed in Japanese Unexamined Patent Publication JP-A 11-277782 is a thermal head which has, in order to protect a heater element, at least a single protective film formed of a carbon protective film made of a material which is predominantly composed of carbon. The content of oxygen present at the interface between the carbon protective film and a layer formed thereunder is set at 20 atm % or below.

Also disclosed therein is a thermal head which has, as the lower layer formed under the carbon protective film, an intermediate protective film. Moreover, as a layer formed under the intermediate protective film, a lower protective film is provided that is made of a ceramics material such as silicon nitride, silicon carbide, or SiAlON. The intermediate protective film is made of a material which is predominantly composed at least of one kind of metal elements selected from the group consisting of metals of the 4A, 5A, and 6A groups, Si, and Ge.

Disclosed in Japanese Unexamined Patent Publication JP-A 2000-177158 is a thermal head composed of: a substrate; a heater element formed on the substrate; an electrode layer connected to the heater element; a protective film for covering at least a heating portion of the heater element; and at least two pieces of anti-static layers formed on the protective film. The two (at least) anti-static layers are made of a metal element selected from the 3A through 7A groups, silicon, and oxygen. In this specification, Ta and Nb are suggested as the examples of the metal element.

Moreover, the two (at least) anti-static layers include an insulating anti-static layer formed in contact with the protective film, and a conductive anti-static layer formed as an uppermost layer. The surface resistance of the insulating anti-static layer is set at $1\times10^4$ Ω or above, whereas the surface resistance of the conductive anti-static layer is set at less than $1\times10^4$ Ω.

Also disclosed therein is a thermal head manufacturing method whereby at least two pieces of the anti-static layers are formed by making changes to the quantity of oxygen supply on the protective film.

Disclosed in Japanese Unexamined Patent Publication JP-A 2001-47652 is a thermal head composed of a discrete electrode layer, a common electrode layer, and a heater element that are all arranged on a substrate. Moreover, on the heater element is formed an insulating protective film, and on the insulating protective film is formed a conductive protective film which is higher in thermal conductivity than the insulating protective film. The conductive protective film constitutes a stacked-layer structure such that the conductive protective film makes direct contact with the common electrode layer at least in the region corresponding to the entire range of effective print width.

Moreover, the conductive protective film is made of a thick-film conductive paste which contains at least ruthenium, the sheet resistance of which is adjusted to fall in a range from 0.5 to 10 MΩ/square.

Disclosed in Japanese Unexamined Patent Publication JP-A 2001-270141 is a thermal head composed of: a substrate; a heater element formed on the substrate; a common electrode layer and a discrete electrode layer connected to the heater element; a protective film formed so as to cover the entire top surface of the substrate; and an anti-static conductive layer formed on the protective film. In this thermal head, part of the protective film located on the common electrode layer is removed, so that the common electrode layer and the conductive layer can make interface-contact with each other in the protective film-free region.

Incidentally, regarding a thermal head such as that in which a conductive protective film is formed on an insulating protective film and the conductive protective film is directly connected to a common electrode layer, the inventors of the present application have found the following problem to be addressed. That is, in a process for cleaning the thermal head, the conductive protective film and the common electrode layer are immersed in a cleaning solution at the same time. In this case, a so-called battery effect takes place between the common electrode layer and the conductive protective film, causing Al that constitutes the discrete electrode layer and the common electrode layer to dissolve into Al ions in the cleaning solution. As a result, the electrode layers could suffer from corrosion (galvanic corrosion)

SUMMARY OF THE INVENTION

The invention has been devised in view of the above-described problems with the related art, and accordingly its object is to provide a thermal head in which battery effect-induced corrosion can be retarded while maintaining excellent anti-static capability in a conductive protective film, a thermal head manufacturing method, and a thermal printer employing the thermal head.

The invention provides a thermal head comprising:

a substrate;

a heater element arranged on a surface of the substrate;

an electrode layer connected to the heater element; and a conductive protective film for covering the heater element and the electrode layer, which makes direct contact with the electrode layer, wherein the conductive protective film comprises a lower conductive protective film laminated on the electrode layer and an upper conductive protective film laminated on the lower conductive protective film, the upper conductive protective film being lower in specific resistance than the lower conductive protective film.

In the invention, it is preferable that the thermal head further comprises an insulating protective film for covering the heater element and a part of the electrode layer.

In the invention, it is preferable that the electrode layer is composed of one electrode layer connected to one side of the heater element and another electrode layer connected to another side of the heater element, and that the one electrode layer is covered with the insulating protective film, whereas the other electrode layer is covered with the lower and upper conductive protective films.

In the invention, it is preferable that at least one of the lower and upper conductive protective films is so formed as to extend over the insulating protective film.

In the invention, it is preferable that the lower conductive protective film is so designed that its specific resistance $\rho 1$ falls within a range from $1.0\times10^7$ Ω cm to $1.0\times10^9$ Ω cm, and that the upper conductive protective film is so designed that its specific resistance $\rho 2$ is equal to or less than $5.0\times10^6$ Ω cm.

In the invention, it is preferable that the lower conductive protective film and the upper conductive protective film are each made of an inorganic material containing carbon (C) and silicon (Si), and that the upper conductive protective film is higher in carbon content than the lower conductive protective film.

In the invention, it is preferable that the upper conductive protective film is made of an inorganic material containing carbon (C) and silicon (Si), the carbon content of which is adjusted to fall within a range from 65 atm % to 90 atm %, and that 95.0% or more of all the carbon-to-carbon bonds (hereafter abbreviated to "C—C bonds") form covalent bonds related to the SP2 hybrid orbital.

The invention provides a thermal head comprising:

a substrate;

a heater element arranged on a surface of the substrate;

an electrode layer connected to the heater element; and a conductive protective film for covering the heater element and the electrode layer, which makes direct contact with the electrode layer, wherein the conductive protective film is so designed that its specific resistance becomes lower gradually from an electrode layer-side part to an outer surface-side part thereof in a thickness direction.

In the invention, it is preferable that the thermal head further comprises an insulating protective film for covering the heater element and a part of the electrode layer.

In the invention, it is preferable that the electrode layer is composed of one electrode layer connected to one side of the heater element and another electrode layer connected to another side of the heater element, and that the one electrode layer is covered with the insulating protective film, whereas the other electrode layer is covered with the conductive protective film.

In the invention, it is preferable that the conductive protective film is so formed as to extend over the insulating protective film.

In the invention, it is preferable that the conductive protective film is so designed that its specific resistance becomes lower continuously from the electrode layer-side part to the outer surface-side part in the thickness direction.

In the invention, it is preferable that the conductive protective film is so designed that its specific resistance becomes lower step wisely from the electrode layer-side part to the outer surface-side part thereof in the thickness direction.

In the invention, it is preferable that the conductive protective film is made of an inorganic material containing carbon (C) and silicon (Si), the carbon content of which becomes higher gradually from the electrode-layer side part to the outer-surface side part thereof in the thickness direction.

The invention provides a method of manufacturing a thermal head, comprising:

a first step of forming, on a surface of a substrate, a heater element and an electrode layer which is connected to the heater element;

a second step of laminating a lower conductive protective film on the electrode layer so as to cover the heater element and the electrode layer;

a third step of laminating, on the lower conductive protective film, an upper conductive protective film having a specific resistance which is lower than that of the lower conductive protective film; and a fourth step of immersing the entire substrate having the lower conductive protective film and the upper conductive protective film formed thereon in a cleaning solution.

The invention provides a method of manufacturing a thermal head, comprising:

a first step of forming, on a surface of a substrate, a heater element and an electrode layer which is connected to the heater element;

a second step of laminating a conductive protective film on the electrode layer so as to cover the heater element and the electrode layer, as well as of adjusting a carbon content of the conductive protective film in such a way that it becomes higher gradually from an electrode-layer side part to an outer-surface side part of the conductive protective film; and a third step of immersing the entire substrate having the conductive protective film formed thereon in a cleaning solution.

In the invention, it is preferable that, in the first step, an insulating protective film is additionally formed for covering the heater element and a part of the electrode layer.

In the invention, it is preferable that, in the first step, one electrode layer connected to one side of the heater element and another electrode layer connected to another side of the heater element are formed, and that the insulating protective film is disposed on the one electrode layer.

The invention provides a thermal printer comprising:

the thermal head mentioned above;

conveyance means for conveying a recording medium; and press means for pressing the recording medium against the heater element of the thermal head.

The invention provides a thermal printer comprising:

the thermal head mentioned above;

conveyance means for conveying a recording medium in a direction from the one electrode layer to the other electrode layer; and press means for pressing the recording medium against the heater element of the thermal head, wherein the conductive protective film is so formed as to extend over the insulating protective film.

According to the invention, even if the substrate is wholly immersed in a cleaning solution in the process of cleaning the electrode layer, by virtue of interposition of the lower conductive protective film, it is possible to reduce the quantity of electrons traveling between the upper conductive protective film and the common electrode layer with a substantial increase in resistance therebetween through the resultant circuit provided against the battery effect. This helps retard corrosion that occurs in the electrode layer.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
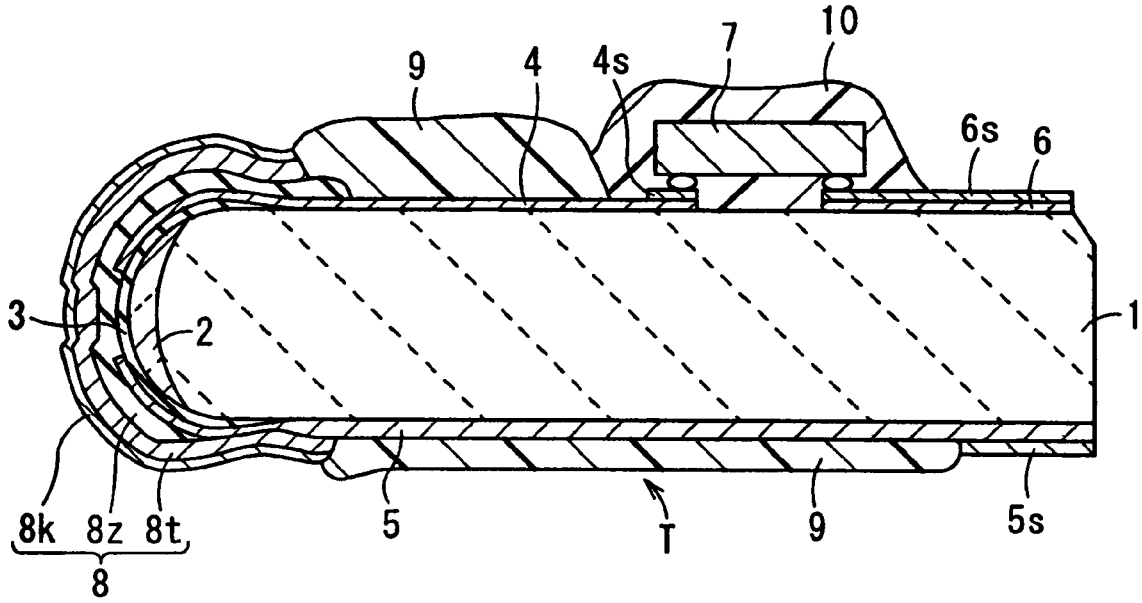
FIG. 1 is a sectional view of a thermal head according to one embodiment of the invention.

Now referring to the drawings, preferred embodiments of the invention are described below.

FIG. 1 is a sectional view of a thermal head according to one embodiment of the invention. The thermal head is mainly composed of: a substrate 1; a plurality of heater elements 3 made of tantalum nitride or the like; a discrete electrode layer 4 and a common electrode layer 5 made of aluminum (Al) or the like; and a driver IC 7. The substrate 1 has, at its end face, a glazed layer 2 made of glass or the like material. A plurality of heater elements 3 are laminated on the glazed layer 2. The discrete electrode layer 4 and the common electrode layer 5 are laminated on the upper surface and the lower surface of the substrate 1, respectively. The driver IC (Integrated Circuit) 7 selectively drives the heater elements 3 to generate Joule heat.

[Thermal Head]

In the invention, for example, the substrate 1 of the thermal head is formed of an electrically insulating material such as alumina ceramics having a quadrilateral shape. Alternatively, the substrate 1 may also be formed of a silicon single crystal or the like, the surface of which is clothed with an insulating film.

The substrate 1 functions as a supporting-based material that supports, at its end face, the strip-like glazed layer 2, the heater element 3, and a protective film 8, and also supports, at its upper and lower surfaces, the discrete electrode layer 4 and the common electrode layer 5, respectively. For example, the end face of the substrate 1 is so shaped as to have a circularly arcuate cross-sectional profile. At the top of the end face are arranged the heater element 3.

The substrate 1 is obtained as follows. For example, in a case where it is formed of alumina ceramics, at the outset, a suitable organic solvent is admixed to powder of a ceramic raw material such as alumina to form a slurry. Then the slurry may be formed into a ceramic green sheet using a conventionally-known technique such as the doctor blade method or calender rolling method. After that, the ceramic green sheet is stamped into a predetermined shape and is then fired at a high temperature (approximately 1600° C.).

The strip-like glazed layer 2 formed at the end face of the substrate 1 acts to accumulate, in its inside, heat generated by the heater element 3 so that satisfactory thermal responsiveness can be maintained in the thermal head T.

The glazed layer 2 is obtained as follows. At the outset, a glass paste is prepared by admixing a suitable organic solvent and organic binder to glass powder. The glass paste is then print-coated on a predetermined region of the substrate 1 by means of the conventionally-known screen printing or the like method. After that, the coating is processed into a predetermined shape by means of the conventionally-known photolithography and etching, and then may be heated at a high temperature ranging from 850° C. to 950° C. over a predetermined period of time.

On the strip-like glazed layer 2 described just above are laminated a large number of heater elements 3. The heater elements 3 are aligned in a row or arranged in a staggered configuration. More specifically, the heater elements 3 are arranged laminatedly in a line at a density of 200 dpi (dot per inch), 300 dpi, or 600 dpi. Each of the heater elements 3 may be formed of a resistor layer made of an electrical resistance material such as a TaSiO-based material, TaSiNO-based material, TiSiO-based material, TiSiCO-based material, or NbSiO-based material.

Meanwhile, the electrode layers connected to both ends of the heater element 3 are made of a metal material such as aluminum (Al) or copper (Cu). The discrete electrode layer 4 and the common electrode layer 5 constitute such electrode layers. The discrete electrode layer 4 extends from one end of the heater element 3 to the upper surface of the substrate 1, for providing connection between the respective heater element 3 and the driver IC 7. The common electrode layer 5 extends from the other end of the heater element 3 to the lower surface of the substrate 1. A plurality of heater elements 3 have uniform connection to the common electrode layer 5 in a shared manner. A pair of the discrete electrode layer 4 and the common electrode layer 5 functions as a feed wiring for supplying electricity derived from an external power source to the heater element 3. When the switching element of the driver IC 7 is brought into an ON state, electric current is produced and passes through the common electrode layer 5 and the discrete electrode layer 4 in this order, causing the heater element 3 to generate Joule heat.

The discrete electrode layer 4 is routed from one end of the heater element 3 toward a predetermined region of the upper surface of the substrate 1 on which the driver IC 7 is mounted. At the termination of the discrete electrode layer 4 is disposed a pad portion 4*s* for establishing connection with the driver IC 7. Moreover, the discrete electrode layer 4 is connected respectively to the switching element and the ground terminal of the driver IC 7, as well as to a negative terminal of an external power source maintained at ground potential (0V to 2V, for instance) by way of an external wiring of an external substrate. The external substrate is connected relatively to the other end of the substrate 1 through a signal electrode layer 6.

On the other hand, the common electrode layer 5 is routed from the other end of the heater element 3 toward the lower surface of the substrate 1. At the termination of the common electrode layer 5 is disposed a pad portion 5*s* for establishing connection with a jumper cable (not shown) which is connected to the external wiring of the external wiring substrate. The common electrode layer 5 is connected to the positive terminal of the external power source maintained at a predetermined positive potential (20V to 25V, for instance) by way of the jumper cable connected with the pad portion 5*s* disposed on the lower surface of the substrate 1.

Moreover, the common electrode layer 5 makes contact with a lower conductive protective film 8*t* contacted by an upper conductive protective film 8*k* as will be described later. In this way, static electricity, which is generated on the upper conductive protective film 8*k* in accompaniment with contact of a sliding recording medium K during actuation of the thermal printer, can be dissipated into the common electrode layer 5 through the lower conductive protective film 8*t*.

Meanwhile, on the upper surface of the substrate 1, the signal electrode layer 6 may be routed from the driver IC 7—mounted region toward the region acting as the connection with the external wiring formed on the external substrate. The signal electrode layer 6 acts to input an input signal fed from the external wiring to the driver IC 7 by way of a pad portion 6*s* thereof.

Moreover, the heater element 3 and the electrode layers 4 and 5 are clothed with the protective film 8 for covering purposes.

In the protective film 8—free regions of the electrode layers 4 and 5 are formed the above-described electrode-layer pad portions 4*s* and 5*s*, respectively.

The protective film 8 takes on a multi-layer structure. That is, an insulating protective film 8*z*, the lower conductive protective film 8*t*, and the upper conductive protective film 8*k* are successively laminated in this order on the heater element 3, part of the discrete electrode layer 4, and part of the common electrode layer 5 disposed in the vicinity of the heater element 3.

It is preferable that the protective film 8 provides the following: anti-abrasion capability for protecting the constituent components such as the heater element 3 from the influence of contact of the sliding recording medium K during actuation of the thermal printer; anti-static capability for protecting the constituent components such as the heater element 3 from static electricity generated in accompaniment with the sliding contact; and anti-oxidation capability for protecting the constituent components such as the heater element 3 from oxidation caused by contact of moisture and the like contained in the atmosphere.

The protective film 8 is designed to have a thickness falling within a range from 3 μm to 12 μm. The lower limit of the thickness value is determined by adding up the thickness of all layers required to constitute the protective film 8 properly. If the thickness value is less than the lower limit, it is difficult for the layers to play the irrespective roles, as will be described later. On the other hand, the upper limit of the thickness value is optimized in consideration of the thermal conductivity of the heater element 3 with respect to the recording medium.

The insulating protective film 8*z* makes up the lowermost layer of the protective film 8, for covering the heater element 3, the discrete electrode layer 4, and the common electrode layer 5. The insulating protective film 8*z* helps prevent a short circuit from occurring between the discrete electrode layer 4 and the common electrode layer 5 owing to the lower conductive protective film 8*t* and the upper conductive protective film 8*k* for covering these electrode layers 4 and 5.

In order to ensure electrical insulation between the conductive protective film portion (the lower conductive protective film 8*t* and the upper conductive protective film 8*k*) and the discrete electrode layer 4, on the side of the discrete electrode layer 4 at the junction with the heater element 3, the insulating protective film 8*z* should preferably be made equal to or greater than the conductive protective film portion in coating area. Moreover, the insulating protective film 8*z* is so formed as not to cover part of the common electrode layer 5, whereby to create a region in which part of the lower conductive protective film 8*t* makes direct contact with the common electrode layer 5. Being made of a SiON-based material that lends itself to enhancement of sealability, the insulating protective film 8*z* provides, in addition to the above stated shorting-prevention capability, oxidation-resistant capability for protecting the constituent components such as the heater elements 3 against moisture and the like contained in the atmosphere.

The insulating protective film 8*z* is so designed that its thickness preferably falls within a range from 1 μm to 7 μm and its specific resistance ρ3 is equal to or greater than $1.0\times10^{10}$ Ω cm. The lower limit of the thickness is a value optimized so as to secure the above stated insulation property and oxidation resistance. On the other hand, the upper limit of the thickness is the maximum value of the thickness of the optimized protective film as a whole, so as not to impair the thermal conductivity of the heater element 3 with respect to the recording medium.

Moreover, on the outer side surfaces of the common electrode layer 5 and the insulating protective film 8*z* is laminated the lower conductive protective film 8*t* may be made of SiC-based material. The lower conductive protective film 8*t* is provided to constitute a circuit for dissipating the static electricity generated on the upper conductive protective film 8*k* laminated thereon to the outside through the common electrode layer 5, as well as to suppress a battery effect which takes place at a cleaning step in the course of manufacture, which will be described later.

The lower conductive protective film 8*t* is so designed that its thickness preferably falls within a range from 0.05 μm to 3 μm and its specific resistance ρ1 falls within a range from $1.0\times10^{7}$ Ω cm to $1.0\times10^{9}$ Ω cm. The lower limit of the thickness value is a value optimized so as to fulfill the capability of suppressing the battery effect during a cleaning step in the process of manufacture as will be described later. On the other hand, the upper limit of the thickness value is a value optimized so as not to impair the thermal conductivity of the heater element 3 with respect to the recording medium.

Moreover, on the outer side surface of the lower conductive protective film 8*t* is laminated the upper conductive protective film 8*k* that may be made of a SiC-based material (hereafter referred to simply as "C—SiC"), the carbon content of which is higher than that of SiC used for forming the lower conductive protective film 8*t*. Anti-abrasion capability and anti-static capability are imparted to the upper conductive protective film 8*k*. On the side of the common electrode layer 5 at the junction with the heater element 3, the upper conductive protective film 8*k* is so formed that it makes no direct contact with the common electrode layer 5 in order to suppress the battery effect. Since both of the lower conductive protective film 8*t* and the upper conductive protective film 8*k* are made of a SiC-based material, it follows that excellent adherence can be attained therebetween; wherefore the upper conductive protective film 8*k* is inhibited from coming off easily.

The upper conductive protective film 8*k* is so designed that its thickness preferably falls within a range from 1 μm to 8 μm and its specific resistance ρ2 is equal to or less than $5.0\times10^{6}$ Ω cm. The lower limit of the thickness value is a value optimized so as to fulfill the anti-abrasion capability. On the other hand, the upper limit of the thickness value is a value optimized so as not to impair the thermal conductivity of the heater element 3 with respect to the recording medium.

As an embodiment of the aforementioned SiC-based material (C—SiC) whose carbon content is higher than that of SiC used for forming the lower conductive protective film 8*t*, in this embodiment, an inorganic material containing carbon (C) and silicon (Si) can be taken up, the carbon content of which is adjusted to fall within a range from 65 atm % to 90 atm %. More specifically, in this inorganic material, most of the carbon-to-carbon bonds, (hereafter abbreviated to "C—C bonds"), that is, 95.0% or more of all the C—C bonds form covalent bonds related to the SP2 hybrid orbital. By employing such a material, since most of the C—C bonds are of covalent bonds related to the SP2 hybrid orbital, it is possible to set the specific resistance of the upper conductive protective film 8*k* at a low value as described above. Note that the possibility that minute quantities of substances other than C and Si are contained in the inorganic material shall not be ruled out.

On the other hand, as an example of SiC used for forming the lower conductive protective film 8*t*, an inorganic material containing carbon (C) and silicon (Si) can be taken up, the carbon content of which is adjusted to fall within a range from 40 atm % to 60 atm %, whereas the silicon content of which is adjusted to fall within a range from 60 atm % to 40 atm %. Note that the possibility that minute quantities of substances other than C and Si are contained in the inorganic material shall not be ruled out.

In the invention, the specific resistance of each individual protective film portion is obtained by calculation as follows. At the outset, there is prepared an alumina-ceramics substrate having a glazed layer formed on the entire surface thereof. On the substrate is deposited a single protective film as a target to be measured. Then, its sheet resistance and film thickness are measured with use of a resistivity meter "Hiresta-UP" (manufactured by MITSUBISHI CHEMICAL CORPORATION) and a contact-type film-thickness gage "ALPHA STEP 500" (manufactured by KLC-TENCOR CORPORATION), respectively. Note that the thickness of the film is measured by exploiting a difference in level resulting from film deposition with a masking process.

Substituting the values of the sheet resistance and the film thickness thus obtained into the following equation yields the specific resistance of the film.

Equation (1)

$$\rho(\Omega\cdot\text{cm})=[\text{film thickness }(\mu\text{m})\times\text{sheet resistance }(\Omega/\text{square})]/10000 \quad (1)$$

Note that, as to each of the sheet resistance and film thickness values, substituted into Equation (1) is the mean value of all the data obtained through five measurements performed for each sample on an individual basis.

On the upper surface of the substrate 1, the position of the termination of the routing of the discrete electrode layer 4 is not covered with the protective film 8 thus far described. In this protective film 8-free region are formed the pad portion 4*s* of the discrete electrode layer 4 and the pad portion 6*s* of the signal electrode layer 6. The driver IC 7 having a solder bump can be emplaced in confrontation with these pad portions 4*s* and 6*s*.

It is preferable that the driver IC 7 is electrically connected to the heater element 3 through the discrete electrode layer 4, for controlling the passage of electric current through the heater element 3. In the driver IC 7 is disposed an integrated circuit which has its constituent elements such as a shift resistor, a latch, a switching element, an input terminal, and an output terminal mounted on one main surface of a silicon substrate at high density.

It is preferable that the driver IC 7 is operated as follows. In the driver IC 7, externally supplied image data is inputted, in synchronism with a clock signal, to the shift register by way of the input terminal. Moreover, the image data thus inputted is stored in the latch at a predetermined timing associated with a latch signal. While a strobe signal is being inputted to the switching element, the heater element 3 is energized on the basis of the image data stored in the latch.

The driver IC 7 such as explained herein is preferably produced by using a conventionally-known semiconductor manufacturing technique. The driver IC 7 in finished form is preferably mounted on the upper surface of the substrate 1 by electrically connecting the input and output terminals to the pad portions 4*s* and 6*s* of the discrete electrode layer 4 and the signal electrode layer 6 by means of the conventionally-known wire bonding method, tape automatic bonding method, or face down bonding method.

Moreover, the driver IC 7 is sealed with a sealing resin 10 made of a thermosetting resin material such as epoxy resin. The sealing resin 10 is mountain-shaped in cross section, and protects the electrode layers and the driver IC 7 from corrosion caused by contact of moisture and the like contained in the atmosphere.

Thus, the thermal head T according to the embodiment of the invention can fulfill its function as follows. Electric power is applied between the discrete electrode layer 4 and the common electrode layer 5 in accompaniment with actuation of the driver IC 7, with the recording medium K kept in sliding contact with the heater elements 3 arranged at the end face of the substrate 1. Thereby, the heater elements 3 are driven individually and selectively to generate Joule heat on the basis of a print signal. The generated heat is then transmitted to the recording medium K to form a print image on the recording medium K.

[Manufacturing Method]

Next, in a method of manufacturing a thermal head according to one embodiment of the invention, one example will be described with reference to FIGS. 2A through 2H.

Process step 1: Firstly, the glazed layer 2, the heater element 3, and the electrode layers 4, 5, and 6 to be connected to the heater element 3 are formed in predetermined regions on the substrate 1 (refer to FIG. 2A).

The heater element 3 and the electrode layers 4, 5, and 6 can be produced by using a conventionally-known thin-film forming technique such as sputtering, photolithography, or etching.

More specifically, at the outset, an electrical resistance material such as TaSiO and a metal material such as aluminum are successively laminated on the substrate 1 by means of the conventionally-known sputtering to form a stacked layer body including a heating resistor layer and an electrode-formation thin film. The stacked layer body is then subjected to a minute patterning process, using the conventionally-known photolithography and etching technique, to constitute the heater element 3 and the electrode layers 4, 5, and 6.

Process step 2: Secondly, the insulating protective film 8*z* is so formed as to extend from the upper part of the discrete electrode layer 4 over the heater element 3. Note that in a case where at the termination of the discrete electrode layer 4 is formed the pad portion 4*s* for establishing connection with the driver IC 7, the termination and a nearby part are preferably left exposed without being covered with the protective film 8 including the insulating protective film 8*z*. In a case where the insulating protective film 8*z* is made of SiON for instance, it can be formed by using a conventionally-known thin-film forming technique such as the sputtering method, vapor deposition method, or CVD method (refer to FIG. 2B).

Process step 3: Thirdly, the lower conductive protective film 8*t* is formed on the common electrode layer 5 and on the insulating protective film 8*z*. Note that at the termination of the common electrode layer 5 located on the lower surface of the substrate 1 may be formed the pad portion 5*s* for establishing connection with the jumper cable. The termination at which the pad portion 5*s* is formed and a nearby part are preferably left exposed without being covered with the protective film 8 including the lower conductive protective film 8*t*.

Figure 2A:
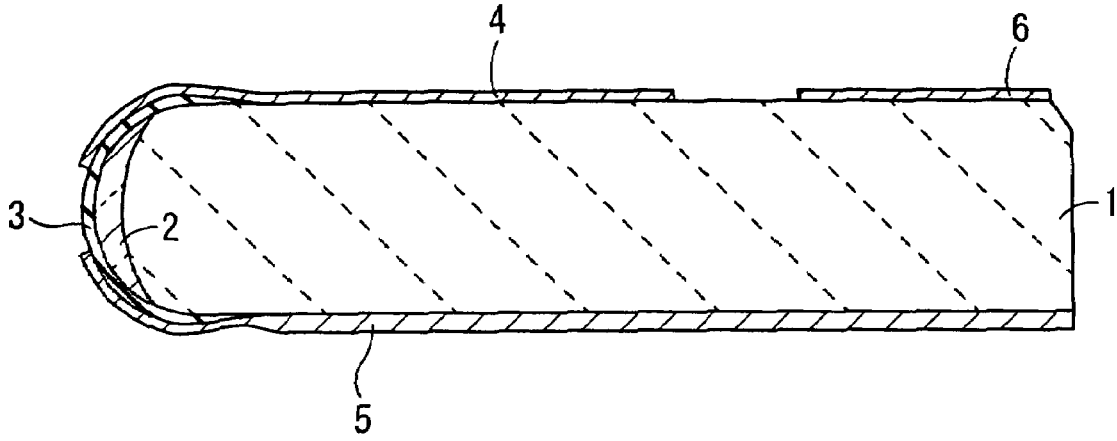
FIGS. 2A through 2H are sectional views showing process steps for manufacturing the thermal head according to one embodiment of the invention.
Figure 2B:
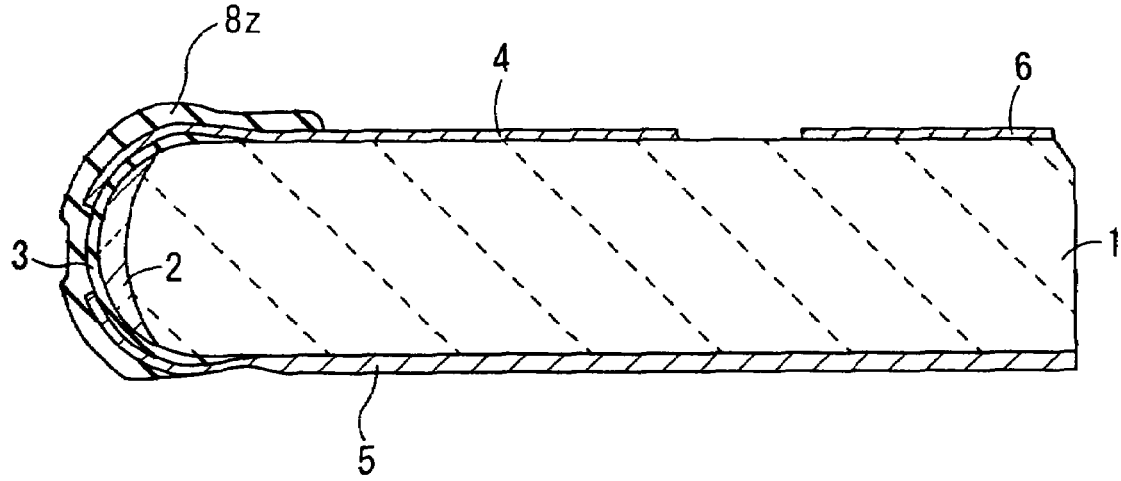
Figure 2C:
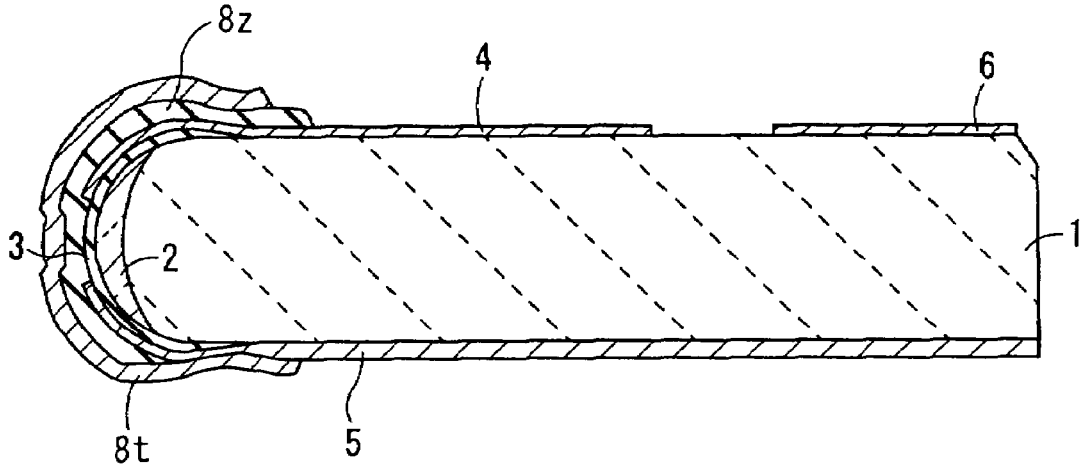
Figure 2D:
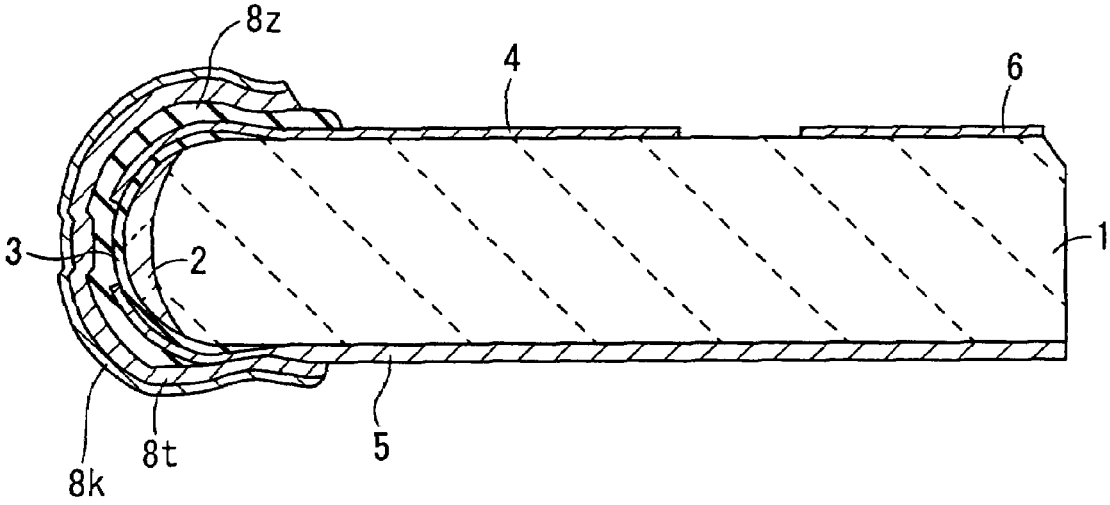
Figure 2E:
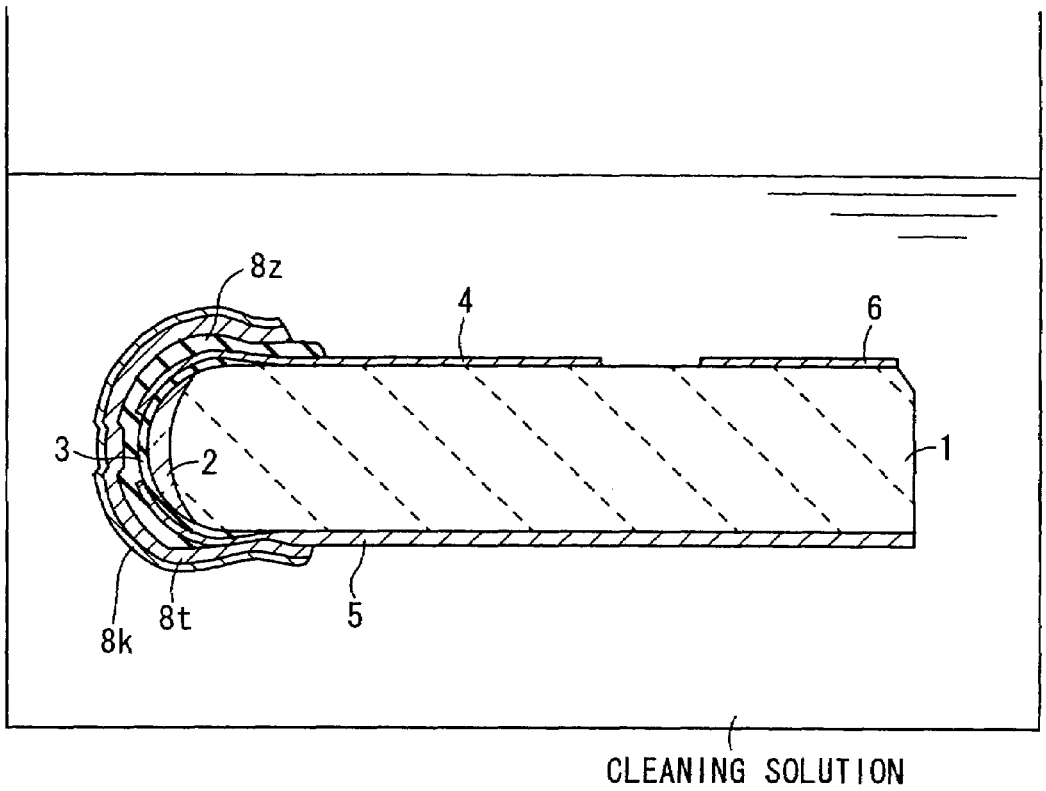
Figure 2F:
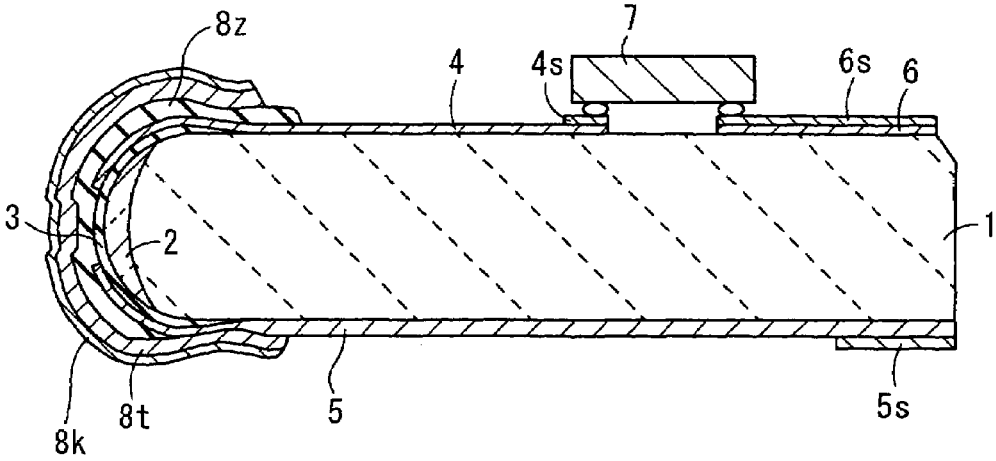
Figure 2G:
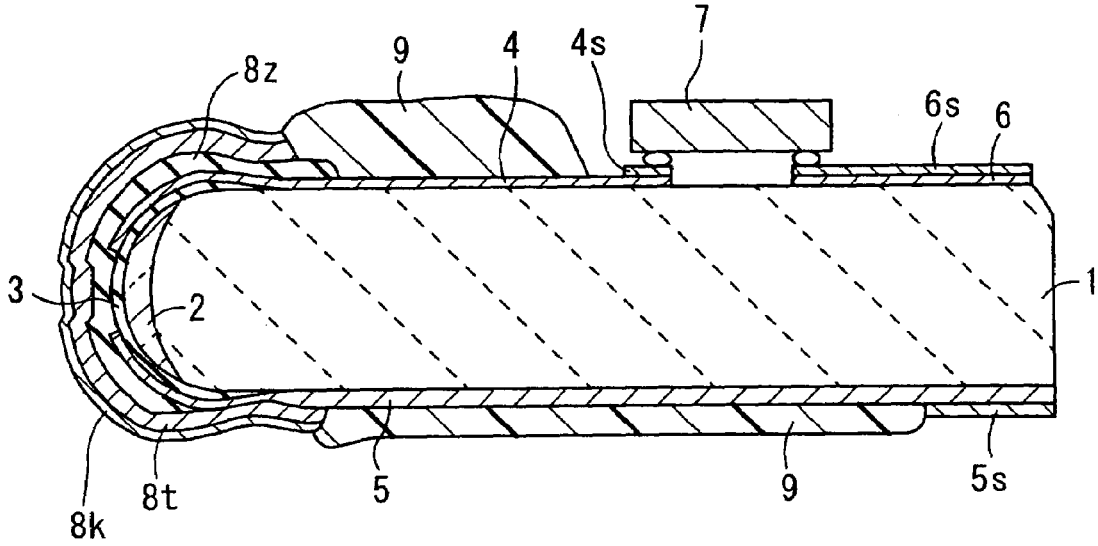
Figure 2H:
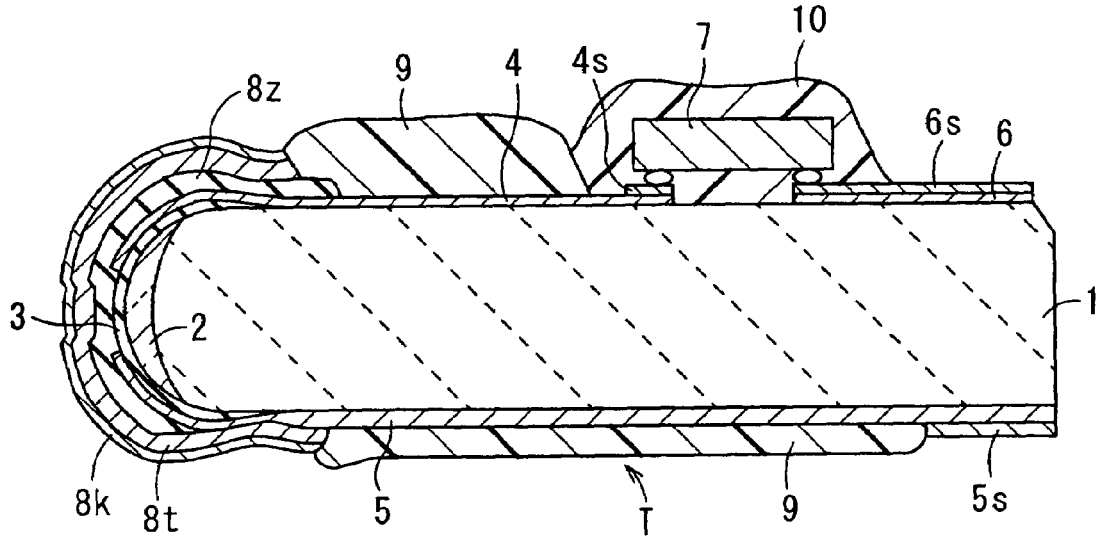

The lower conductive protective film 8*t* such as explained herein is formed by using a conventionally-known thin-film forming technique such as the sputtering method, vapor deposition method, or CVD method (refer to FIG. 2C).

For example, in a case where the lower conductive protective film 8*t* is formed of SiC by using the sputtering method selected as an adequate thin-film forming technique, at the outset, in a chamber of a sputtering apparatus are preferably placed a target material made of a sintered body in which C and Si are intermixed at a mole ratio of, for instance, 50:50, and the substrate 1 having the heater element 3, the electrode layers, and the insulating protective film 8*z* laminated thereon. Then, the composition substances of the target material are preferably sputtered by applying predetermined electric power between the target material and the substrate 1 while argon gas is being introduced into the chamber. At this time, the flow rate of the argon gas is preferably set at 100 SCCM (standard cc ($cm^3$)/min) and the pressure in the chamber is set at 5 mTorr.

Process step 4: Fourthly, the upper conductive protective film 8*k* is formed on the lower conductive protective film 8*t*. For example, in a case where the upper conductive protective film 8*k* is made of C—SiC, it can be formed by means of sputtering just as in the case of forming the lower conductive protective film 8*t* with use of SiC. A target material for use can be made of a sintered body in which C and Si are intermixed at a mole ratio of, for example, 80:20. At this time, the flow rate of the argon gas is preferably set at 100 SCCM and the pressure in the chamber is set at 5 mTorr. In the case of forming the upper conductive protective film 8*k* in the above stated manner, in order for 95% or more of the C—C bonds present in the upper conductive protective film 8*k* to be SP2 bonds, the temperature of the substrate 1 is preferably kept within a range from 200° C. to 300° C. at all times during the formation of the film (refer to FIG. 2D).

Process step 5: Fifthly, it is preferable that the substrate 1 is wholly immersed in a cleaning solution to remove foreign substances or organic substances which adhered to the entire surface thereof, particularly those present on the surfaces of the electrode layers. The preferred examples of the cleaning solution for use include a hydrocarbon-based acidic cleaning agent and higher alcohol-based neutral cleaning agent. Note that the cleaning solution exhibits an electrolyte property due to the cleaning agent contained therein. This cleaning process is carried out prior to formation of a primary coating layer for the solder bump on the pad portion 4*s* by means of plating or the like method in a subsequent process, prior to formation of the solder bump on the primary coating layer, or prior to affixation of an anisotropic conductive film onto the pad portions 5*s* and 6*s* (refer to FIG. 2E).

In the cleaning process, when the substrate 1 is immersed in the cleaning solution, a potential difference is caused owing to the difference in standard electrode potential between the upper conductive protective film 8*k* and the electrode layer. However, there is a substantial increase in resistance between the upper conductive protective film 8*k* and the electrode layer because of the interposition of the lower conductive protective film 8*t*. Therefore, in contrast to the case where the lower conductive protective film is absent, electrons traveling from the upper conductive protective film 8*k* to the electrode layer are small in quantity. This makes it possible to protect the electrode layer against corrosion resulting from the battery effect. Even the discrete electrode layer 4 which is made smaller in film thickness than the common electrode layer 5, in particular, is free from corrosion-induced functional disruption, which results in an advantage in improving yields.

As another advantage, it is possible to use a cleaning solution with a stronger cleaning power. At this time, it is possible to clean the pad portions 4*s*, 5*s*, and 6*s* located at the terminations of the electrode layers more thoroughly. Therefore, this makes it possible to enhance the connection reliability for the driver IC 7 and the external wiring at the pad portions 4*s* and 5*s*.

Process step 6: Sixthly, the pad portion 4*s* of the discrete electrode layer 4 and the pad portion 6*s* of the signal electrode layer 6 are each plated with nickel and gold by means of electroless plating. Then, the driver IC 7 is emplaced thereon (refer to FIG. 2F).

Process step 7: Seventhly, the exposed, protective film 8-free parts of the discrete electrode layer 4 and the common electrode layer 5 are covered with a coating resin 9 (refer to FIG. 2G).

Process step 8: Lastly, after being mounted, the driver IC 7 having the solder bump is sealed through application of the sealing resin 10. Thereupon, the thermal head is completed (refer to FIG. 2H).

For example, the sealing resin 10 is formed by coating a predetermined liquid precursor made of epoxy resin so as to cover the driver IC 7 mounted on the substrate 1, followed by performing firing to achieve polymerization at a high temperature (130° C. to 150° C.)

[Thermal Printer]

Next, a description will be given below as to a thermal printer having the thermal head T incorporated therein.

Figure 3:
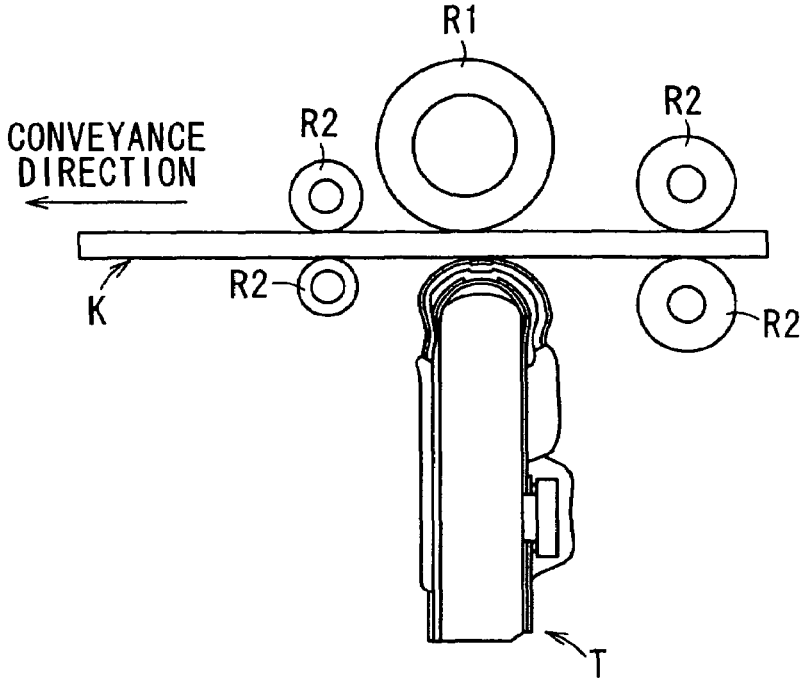
FIG. 3 is a schematic sectional view of a thermal printer according to one embodiment of the invention.

As shown in FIG. 3, in the thermal printer embodying the invention, on the thermal head T thus far described are arranged a platen roller R1 and conveyance rollers R2 that are operated under the control of driving means. The platen roller R1 acts as means for pressing the recording medium K and an ink ribbon I against the thermal head T. The conveyance rollers R2 act as means for conveying the recording medium K and the ink ribbon I.

Preferably, the platen roller R1 is, for example, designed to be 8 mm to 50 mm in diameter. Specifically, the platen roller R1 is composed of a cylindrical-shaped member having a butadiene rubber or the like material wound around the outer circumference of the core shaft thereof made of a metal material such as SUS. The platen roller R1 is rotatably supported on the heater element 3 of the thermal head T.

The platen roller R1 acts to press the recording medium K and the ink ribbon I against the thermal head T, so that heat generated by the heater element 3 is transmitted to the ink ribbon I. With the heat, the ink of the ink ribbon I can be transferred onto the recording medium K. Moreover, the platen roller R1 acts to convey the recording medium in a direction substantially perpendicular to the direction in which the heater elements 3 are arranged.

Thus, the thermal printer of the invention can fulfill its function as follows. Electric power is applied between the discrete electrode layer 4 and the common electrode layer 5 in accompaniment with actuation of the driver IC 7, with the recording medium K kept in sliding contact with the heater elements 3 arranged on the upper surface of the substrate 1 by the platen roller R1. Thereby, the heater elements 3 are driven individually and selectively to generate Joule heat on the basis of a print signal. The generated heat is then transmitted to the recording medium K to form a print image thereon.

Note that the invention should not be interpreted to be limited to the embodiments described hereinabove, and a variety of modifications and changes may be made in the invention without departing from the gist of the invention.

For example, although the above description as to the embodiments deals with the case where the thermal head is designed as a so-called end-face type head having the heater element 3 formed at the end face thereof, the thermal head may alternatively be designed as a so-called plane-surface type head having the heater element 3 formed on the upper surface of the substrate thereof.

Moreover, although the above description as to the embodiments deals with the case where the lower conductive protective film 8*t* is made of SiC, the invention is not limited thereto. In a case where a difference in standard electrode potential is observed between the upper conductive protective film and the electrode layer, by interposing the lower conductive protective film therebetween, it is possible to reduce the quantity of electrons traveling between the upper conductive protective film and the common electrode layer during immersion in the cleaning solution, and thereby suppress the battery effect. So long as the lower conductive protective film is able to function for such an intended purpose, instead of SiC, a TiC-based material, a TaC-based material, a Si-based material, a SiCN-based material are also usable.

Further, although the above description as to the embodiments deals with the case where corrosion takes place in the electrode layer, it is also conceivable that the upper conductive protective film could be dissolved undesirably. Specifically, assume that the electrode layer and the upper conductive protective film are formed of a combination of substances such that electrons are fed from the electrode layer to the upper conductive protective film that will eventually cause the upper conductive protective film to dissolve. Also in this case, by interposing the lower conductive protective film between the electrode layer and the upper conductive protective film, it is possible to protect the upper conductive protective film against undesirable dissolution, and thereby prevent occurrence of degradation in the abrasion resistance resulting from dissolution of the upper conductive protective film.

Figure 4:
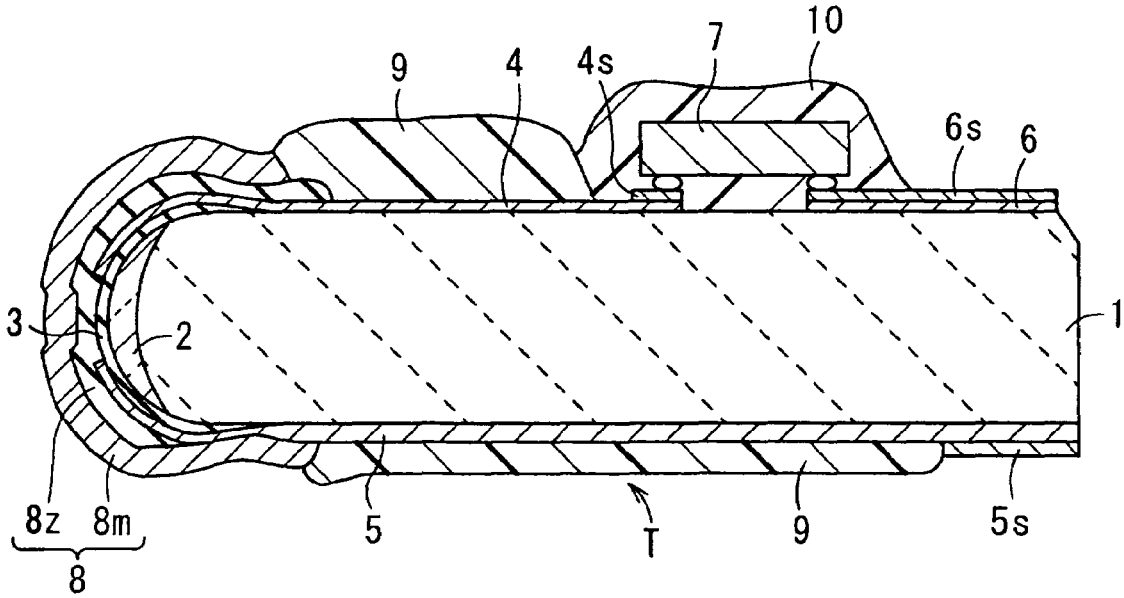
FIG. 4 is a sectional view of a thermal head according to an another embodiment of the invention.

Still further, although the above description as to the embodiments deals with the case where the conductive protective film has a double-layer structure including the lower conductive protective film 8*t* and the upper conductive protective film 8*k*, like another embodiment of the invention as shown in FIG. 4, the conductive protective film 8*m* may also be so formed as to have a single-layer structure in which the specific resistance becomes lower gradually from the electrode layer-side part to the outer surface-side part thereof in the thickness direction. The conductive protective film having such a structure is also able to fulfill anti-corrosion capability and anti-static capability. Note that this conductive protective film may be formed in such a way that its specific resistance becomes lower continuously or stepwisely from the electrode layer-side part to the outer surface-side part thereof in the thickness direction.

In a method of manufacturing a thermal head according to an another embodiment of the invention, one example will be described with reference to FIGS. 5A through 5G.

Process step 1: Firstly, the glazed layer 2, the heater element 3, and the electrode layers 4, 5, and 6 to be connected to the heater element 3 are formed in predetermined regions on the substrate 1 (refer to FIG. 5A).

The heater element 3 and the electrode layers 4, 5, and 6 can be produced by using a conventionally-known thin-film forming technique such as sputtering, photolithography, or etching.

More specifically, at the outset, an electrical resistance material such as TaSiO and a metal material such as aluminum are successively laminated on the substrate 1 by means of the conventionally-known sputtering to form a stacked layer body including a heating resistor layer and an electrode-formation thin film. The stacked layer body is then subjected to a minute patterning process, using the conventionally-known photolithography and etching technique, to constitute the heater element 3 and the electrode layers 4, 5, and 6.

Process step 2: Secondly, the insulating protective film 8*z* is so formed as to extend from the upper part of the discrete electrode layer 4 over the heater element 3. Note that in a case where at the termination of the discrete electrode layer 4 is formed the pad portion 4s for establishing connection with the driver IC 7, the termination and a nearby part are preferably left exposed without being covered with the protective film 8 including the insulating protective film 8*z*. In a case where the insulating protective film 8*z* is made of SiON for instance, it can be formed by using a conventionally-known thin-film forming technique such as the sputtering method, vapor deposition method, or CVD method (refer to FIG. 5B).

Process step 3: Thirdly, the conductive protective film 8*m* is formed on the common electrode layer 5 and on the insulating protective film 8*z*. Note that at the termination of the common electrode layer 5 located on the lower surface of the substrate 1 may be formed the pad portion 5*s* for establishing connection with the jumper cable. The termination at which the pad portion 5*s* is formed and a nearby part are preferably left exposed without being covered with the protective film 8 including the conductive protective film 8*m*.

In this conductive protective film 8*m*, its specific resistance ρ' is adjusted to fall within a range from $1.0\times10^7$ Ω cm to $1.0\times10^9$ Ω cm on the electrode-layer side part (the region located near the electrode layer, the thickness of which accounts for approximately 10% of the thickness of the conductive protective film as a whole) yet adjusted to be equal to or smaller than $5.0\times10^6$ Ω cm on the outer-surface side part (the region located near the outer surface, the thickness of which accounts for approximately 10% of the thickness of the conductive protective film as a whole). Preferably, the conductive protective film 8*m* is made of a SiC-based material, the carbon content of which becomes higher gradually from the electrode-layer side part to the outer-surface side part thereof.

Figure 5A:
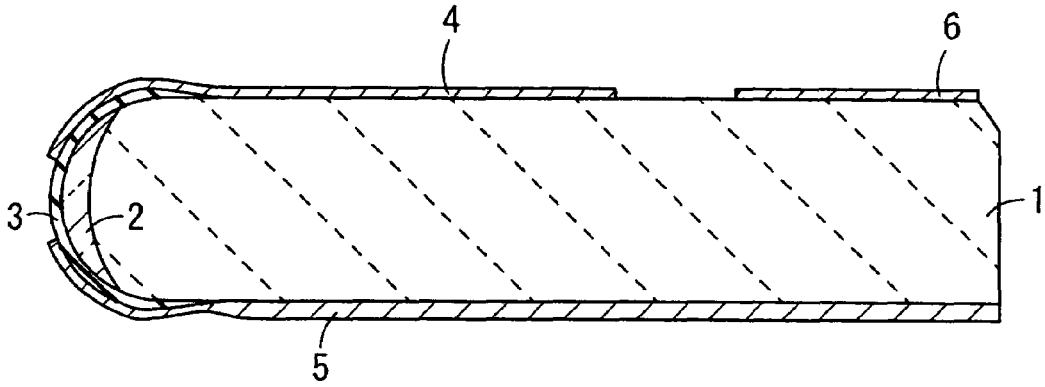
FIGS. 5A through 5G are sectional views showing process steps for manufacturing the thermal head according to another embodiment of the invention.
Figure 5B:
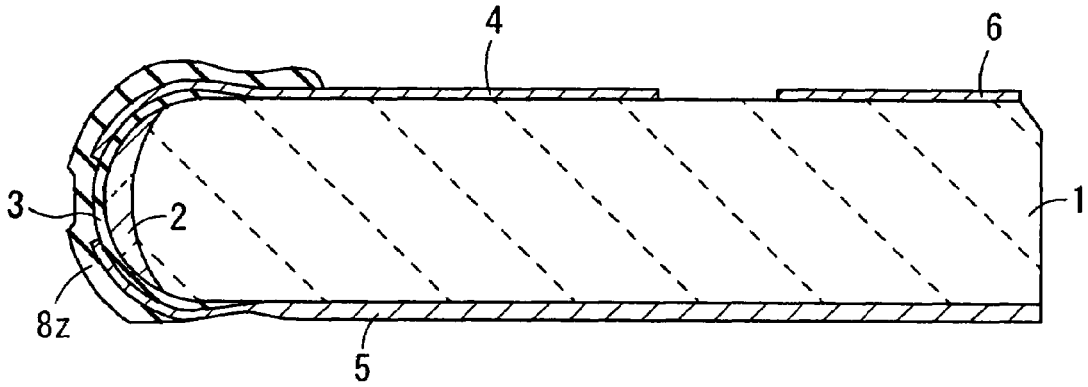
Figure 5C:
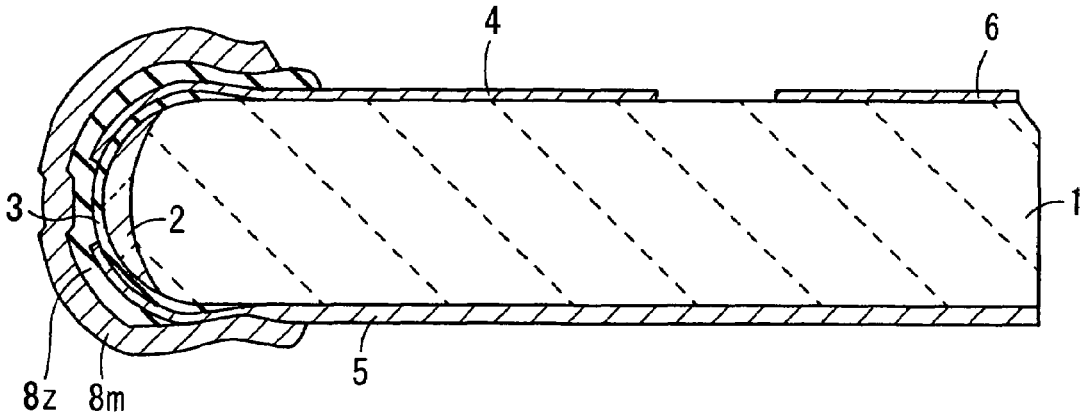
Figure 5D:
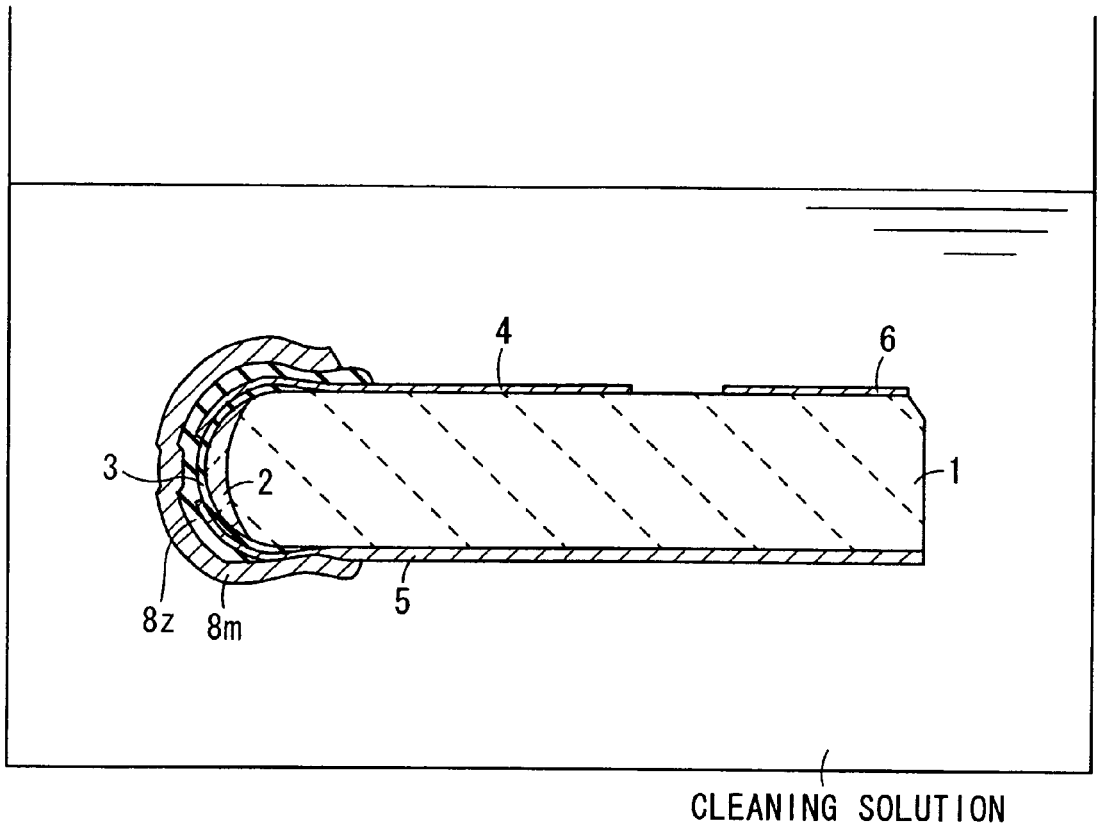
Figure 5E:
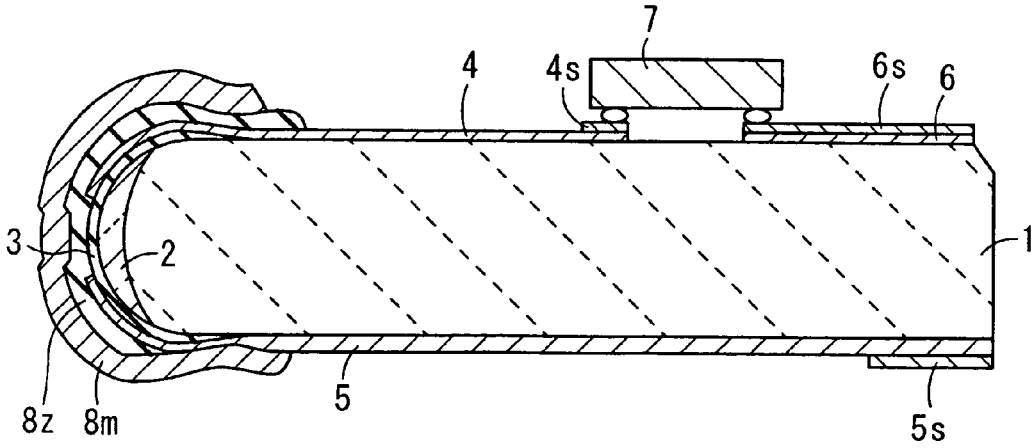
Figure 5F:
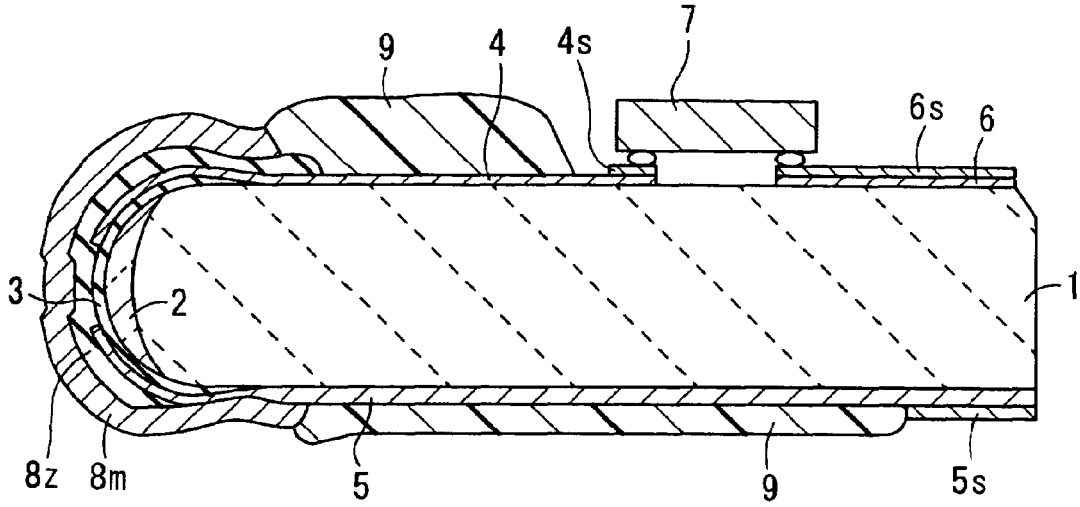
Figure 5G:
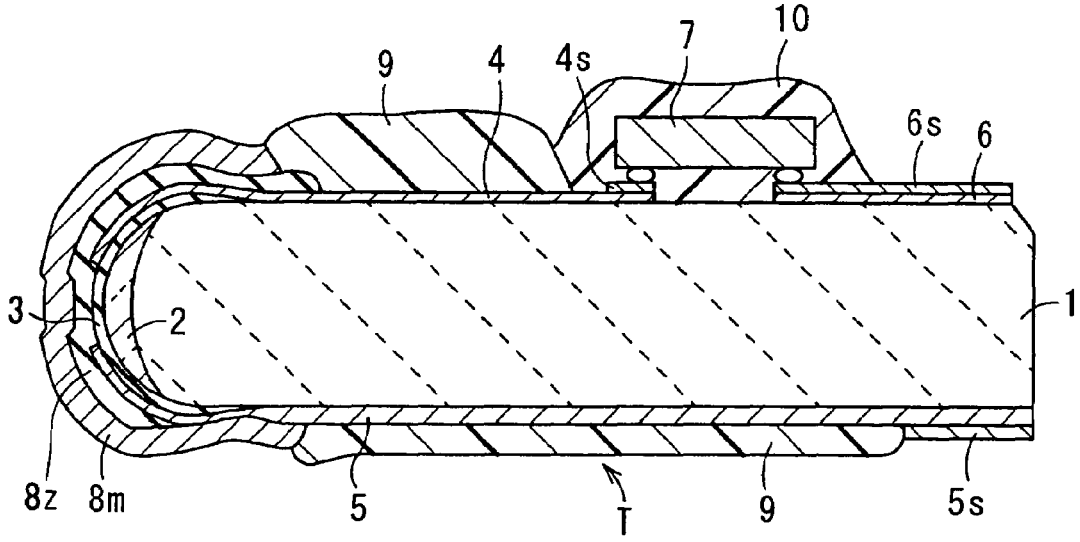

The conductive protective film 8*m* is preferably formed by using a known thin-film forming technique such as the sputtering method, vapor deposition method, or CVD method (refer to FIG. 5C).

For example, in a case where the conductive protective film 8*m* is formed of SiC by using the multi-dimensional sputtering method selected as an adequate thin-film forming technique, at the outset, a target material containing Si and a target material containing C are placed in a chamber of a sputtering apparatus. Then, the quantity of C sputtered atoms is caused to gradually increase while keeping the quantity of Si sputtered atoms invariant.

Alternatively, in a case where the conductive protective film is formed of SiC by using the ARE (Activated Reactive Evaporation) method, a metal Si is deposited onto the substrate, with the degree of evaporation kept constant, in a $C_2H_2$ reactive gas atmosphere wherein the flow rate is caused to increase gradually.

Process step 4: Fourthly, it is preferable that the substrate 1 is wholly immersed in a cleaning solution to remove foreign substances or organic substances which adhered to the entire surface thereof, particularly those present on the surfaces of the electrode layers. The preferred examples of the cleaning solution for use include a hydrocarbon-based acidic cleaning agent and higher alcohol-based neutral cleaning agent. Note that the cleaning solution exhibits an electrolyte property due to the cleaning agent contained therein. This cleaning process is carried out prior to formation of a primary coating layer for the solder bump on the pad portion 4*s* by means of plating or the like method in a subsequent process, prior to formation of the solder bump on the primary coating layer, or prior to affixation of an anisotropic conductive film onto the pad portions 5*s* and 6*s* (refer to FIG. 5D).

In the cleaning process, when the substrate 1 is immersed in the cleaning solution, a potential difference is caused owing to the difference in standard electrode potential between the conductive protective film 8*m* and the electrode layer. However, there is a substantial increase in resistance between the upper conductive protective film 8*m* and the electrode layer owing to decreasing gradually the specific resistance of the conductive protective film 8*m* from the electrode layer-side part to the outer surface-side part in the thickness direction thereof. Therefore, electrons traveling from the outer surface-side part of the conductive protective film 8*m* to the electrode layer are small in quantity. This makes it possible to protect the electrode layer against corrosion resulting from the battery effect. Even the discrete electrode layer 4 which is made smaller in film thickness than the common electrode layer 5, in particular, is free from substantial corrosion-induced functional disruption, which results in an advantage in improving yields.

As another advantage, it is possible to use a cleaning solution with a stronger cleaning power. At this time, it is possible to clean the pad portions 4*s*, 5*s*, and 6*s* located at the terminations of the electrode layers more thoroughly. Therefore, this makes it possible to enhance the connection reliability for the driver IC 7 and the external wiring at the pad portions 4*s* and 5*s*.

Process step 5: Fifthly, the pad portion 4*s* of the discrete electrode layer 4 and the pad portion 6*s* of the signal electrode layer 6 are each plated with nickel and gold by means of electroless plating. Then, the driver IC 7 is emplaced thereon (refer to FIG. 5E).

Process step 6: Seventhly, the exposed, protective film 8-free parts of the discrete electrode layer 4 and the common electrode layer 5 are covered with a coating resin 9 (refer to FIG. 5F).

Process step 7: Lastly, after being mounted, the driver IC 7 having the solder bump is sealed through application of the sealing resin 10. Thereupon, the thermal head is completed (refer to FIG. 5G).

For example, the sealing resin 10 is formed by coating a predetermined liquid precursor made of epoxy resin so as to cover the driver IC 7 mounted on the substrate 1, followed by performing firing to achieve polymerization at a high temperature (130° C. to 150° C.).

In forming the conductive protective film 8*m* thus far described, in contrast to the case of forming the conductive protective film having a double-layer structure including the lower conductive protective film and the upper conductive protective film, there is no need to carry out the sputtering deposition process twice. As another advantage, the conductive protective film is designed as a continuous layer in which the C content in SiC varies gradually. Therefore, the conductive protective film is free from layer separation; that is, separation between the lower conductive protective film and the upper conductive protective film that occurs at the contact interface, which is a problem encountered by the conductive protective film having a double-layer structure in which the lower conductive protective film and the upper conductive protective film are made of different substances.

Moreover, by replacing the thermal head accomplished as one embodiment of the invention as shown in FIG. 3 with the one thus constructed, it is possible to realize a thermal printer that employs the thermal head accomplished as another embodiment of the invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A thermal head comprising:

a substrate;

a heater element arranged on a surface of the substrate;

an electrode layer connected to the heater element; and a protective film for covering the heater element and the electrode layer, which makes contact with the electrode layer, wherein the protective film comprises an insulating protective film laminated on the heater element and part of the electrode layer, a lower conductive protective film directly laminated on the electrode layer and the insulating protective film, and an upper conductive protective film laminated on the lower conductive protective film, and wherein the upper conductive protective film is lower in specific resistance than the lower conductive protective film.

2. The thermal head of claim 1, wherein the electrode layer is composed of one electrode layer connected to one side of the heater element and another electrode layer connected to another side of the heater element, and wherein the lower conductive protective film and the upper conductive protective film are insulated from the one electrode layer by the insulating protective film.

3. The thermal head of claim 1, wherein the lower conductive protective film is so designed that its specific resistance ρ1 falls within a range from $1.0\times10^7$ Ωcm to $1.0\times10^9$ Ωcm, and the upper conductive protective film is so designed that its specific resistance ρ2 is equal to or less than $5.0\times10^6$ Ωcm.

4. The thermal head of claim 1, wherein the lower conductive protective film and the upper conductive protective film are each made of an inorganic material containing carbon and silicon, and the upper conductive protective film is higher in carbon content than the lower conductive protective film.

5. The thermal head of claim 4, wherein the upper conductive protective film is made of an inorganic material containing carbon and silicon, the carbon content of which is adjusted to fall within a range from 65 atm % to 90 atm %, and that 95.0% or more of all the carbon-to-carbon bonds form covalent bonds related to the SP2 hybrid orbital.

6. A thermal printer comprising:

the thermal head of claim 1;

conveyance means for conveying a recording medium; and press means for pressing the recording medium against the heater element of the thermal head.

7. The thermal head of claim 1, wherein the electrode layer is composed of one electrode layer connected to one side of the heater element and another electrode layer connected to another side of the heater element, and wherein the insulating protective film is interposed between the one electrode layer and the lower conductive protective film.

8. A thermal printer comprising:

the thermal head of claim 7;

conveyance means for conveying a recording medium in a direction from the one electrode layer to the other electrode layer; and press means for pressing the recording medium against the heater element of the thermal head, wherein at least one of the lower conductive protective film and the upper protective film is so formed as to extend over the insulating protective film.

9. The thermal head of claim 1, wherein the electrode layer is composed of one electrode layer connected to one side of the heater element and another electrode layer connected to another side of the heater element, and wherein the lower conductive protective film has a region which is in direct contact with part of the another electrode layer.

10. A thermal head comprising:

a substrate;

a heater element arranged on a surface of the substrate;

an electrode layer connected to the heater element; and a protective film for covering the heater element and the electrode Layer, which makes contact with the electrode layer, wherein the protective film comprises an insulating protective film laminated on the heater element and part of the electrode layer, and a conductive protective film directly laminated on the electrode layer and the insulating protective film, and wherein the conductive protective film is so designed that its specific resistance becomes lower gradually from an electrode layer-side part to an outer surface-side part thereof in a thickness direction.

11. The thermal head of claim 10, wherein the electrode layer is composed of one electrode layer connected to one side of the heater element and another electrode layer connected to another side of the heater element, and wherein the conductive protective film is insulated from the one electrode layer by the insulating protective film.

12. The thermal head of claim 10, wherein the conductive protective film is so designed that its specific resistance becomes lower continuously from the electrode layer-side part to the outer surface-side part in the thickness direction.

13. The thermal head of claim 10, wherein the conductive protective film is so designed that its specific resistance becomes lower stepwisely from the electrode Layer-side part to the outer surface-side part thereof in the thickness direction.

14. The thermal head of claim 10, wherein the conductive protective film is made of an inorganic material containing carbon and silicon, the carbon content of which becomes higher gradually from the electrode-layer side part to the outer-surface side part thereof in the thickness direction.

15. A thermal printer comprising:

the thermal head of claim 10;

conveyance means for conveying a recording medium; and press means for pressing the recording medium against the heater element of the thermal head.

16. The thermal head of claim 10, wherein the electrode layer is composed of one electrode layer connected to one side of the heater element and another electrode layer connected to another side of the heater element, and wherein the insulating protective film is interposed between the one electrode layer and the conductive protective film.

17. A thermal printer comprising:

the thermal head of claim 16;

conveyance means for conveying a recording medium in a direction from the one electrode layer to the other electrode layer; and press means for pressing the recording medium against the heater element of the thermal head, wherein the conductive protective film is so formed as to extend over the insulating protective film.

18. The thermal head of claim 10, wherein the electrode layer is composed of one electrode layer connected to one side of the heater element and another electrode layer connected to another side of the heater element, and wherein the conductive protective film has a region which is in direct contact with part of the another electrode layer.

* * * * *